US007424761B1

(12) United States Patent
Graebe

(10) Patent No.: US 7,424,761 B1
(45) Date of Patent: Sep. 16, 2008

(54) SHAPE MATCHING CUSHION

(75) Inventor: Robert H Graebe, Fort Lauderdale, FL (US)

(73) Assignee: Roho, Inc., Belleville, IL (US)

( * ) Notice: Subject to any disclaimer, the term of this patent is extended or adjusted under 35 U.S.C. 154(b) by 14 days.

(21) Appl. No.: 11/707,378

(22) Filed: Feb. 16, 2007

(51) Int. Cl.
*A47C 27/16* (2006.01)

(52) U.S. Cl. ..... 5/653; 5/652; 5/706

(58) Field of Classification Search ..... 5/706, 5/247, 655.3, 652, 653
See application file for complete search history.

(56) References Cited

U.S. PATENT DOCUMENTS

| | | | | | |
|---|---|---|---|---|---|
| 2,433,012 | A | * | 12/1947 | Zalicovitz | 5/247 |
| 3,605,145 | A | * | 9/1971 | Graebe | 5/706 |
| 3,922,409 | A | * | 11/1975 | Stark | 428/44 |
| 4,005,236 | A | | 1/1977 | Graebe | |
| 4,541,136 | A | | 9/1985 | Graebe | |
| 4,605,582 | A | | 8/1986 | Sias et al. | |
| 4,673,605 | A | | 6/1987 | Sias et al. | |
| 4,713,854 | A | | 12/1987 | Graebe | |
| D294,212 | S | | 2/1988 | Sias et al. | |
| 5,052,068 | A | | 10/1991 | Graebe | |
| 5,111,544 | A | | 5/1992 | Graebe | |
| 5,152,023 | A | | 10/1992 | Graebe | |
| D336,198 | S | * | 6/1993 | Gibbons | D6/583 |
| 5,596,781 | A | | 1/1997 | Graebe | |
| 5,749,111 | A | | 5/1998 | Pearce | |
| 5,845,352 | A | | 12/1998 | Matsler et al. | |
| 5,994,450 | A | | 11/1999 | Pearce | |
| 6,026,527 | A | | 2/2000 | Pearce | |
| 6,413,458 | B1 | | 7/2002 | Pearce | |
| 6,487,738 | B1 | | 12/2002 | Graebe | |
| 2005/0223667 | A1 | | 10/2005 | McCann et al. | |

* cited by examiner

*Primary Examiner*—Fredrick Conley
(74) *Attorney, Agent, or Firm*—Polster, Lieder, Woodruff & Lucchesi LC

(57) ABSTRACT

A cushion comprising an array of individual suspension elements arranged in a pattern wherein one embodiment the longitudinal axis of each suspension element in the array is positioned at a right angle or parallel to the longitudinal axes of the adjacent suspension elements. Each suspension element has a displaceable load-bearing surface, a first end wall, a second end wall, and an optional bottom wall, with load-bearing surface and recited walls defining an inner chamber. The material thickness of the load-bearing surface generally is greater than the material thickness of the end walls whereby the end walls deflect outwardly toward the load-bearing surfaces of adjacent support elements under load. The load-bearing surface can have a substantially arch-shaped, elliptical or rectangular cross-section and may be constructed from different materials to make a composite suspension element. The bottom wall of the suspension element may have a small vent opening of a predetermined size to allow a controlled release of air from the inner chamber under load to enhance the viscous feel of the cushion. The cushion also includes a cover enclosing the array of suspension elements.

3 Claims, 4 Drawing Sheets

SHAPE MATCHING CUSHION

CROSS REFERENCE TO RELATED APPLICATIONS

Not Applicable

BACKGROUND OF THE INVENTION

The invention relates generally to support surfaces that facilitate blood flow and prevent tissue breakdown and more particularly to a molded foam cushion having suspension elements that are shaped and positioned to form a shape matching support surface that has relatively uniform restoring forces when deformed under loads from of a user.

Individuals confined to bed or to a wheelchair run the risk of tissue breakdown and the development of ischemic induced sores, which are extremely dangerous and difficult to treat and cure. For example, when seated much of the individual's weight concentrates in the region of the ischia, that is, at the bony prominence of the buttocks, and unless frequent movement occurs, the flow of blood to the skin tissue in these regions decreases to the point that the tissue breaks down. When lying down, the hip region may protrude deeper into the mattress than the adjoining waist or thigh regions and as a consequence the supporting forces exerted by the mattress would be greater at the hips than at the thighs or waist, for example. Any skin area where there are sustained deformation experiences reduced blood flow and the skin does not receive sufficient oxygen and nutrients.

It is desirable to have a support cushion or mattress which applies generally uniform supporting forces, that is, a generally uniform counter force on the tissue of the user positioned on the cushion or mattress. When a cushioning structure is deformed while supporting a person it is desirable to have a constant restoring force that exerts equal forces over a broader area of the body minimizing deformation of the soft tissues and help prevent skin and tissue breakdown by facilitating blood flow in the contacted area.

SUMMARY OF THE INVENTION

One aspect of the invention provides for a cushion having an array of suspension elements. Each suspension element has a displaceable, load-bearing surface, a first end wall, a second end wall, and an optional bottom wall. The load bearing surface, end walls and bottom wall, if present, define an inner chamber. The material thickness of the load-bearing surface is greater than the material thickness of the end walls so that the end walls can distend outwardly when force is applied to said load-bearing surface. The optional bottom wall has a vent opening formed therein of a predetermined size that allows controlled release of air from the chamber when force is applied to the load bearing surface to control collapsing of the cell.

The surface of the cushion is displaceable that, when deformed, exerts a restoring force that is generally constant irrespective of the extent of the deformation. The cushion applies a generally uniform supporting pressure against an irregularly contoured body supported on the cushion.

In one aspect of the invention the array of suspension elements is arranged in a pattern wherein the longitudinal axis of each suspension element is positioned at a right angle relationship to the longitudinal axis of the adjacent suspension elements. The right angle axis position of the suspension elements improves stability imparted to the user.

In another aspect of the invention the axes if adjacent suspension elements are aligned to maintain shape-fitting performance.

In one aspect of the invention the load-bearing surface has a generally arch-like cross-sectional configuration to facilitate a controlled buckling function. In other aspects of the invention the load-bearing surface has a substantially elliptical cross-sectional configuration or a substantially rectangular cross-sectional configuration.

DESCRIPTION OF THE INVENTION

In general, the present invention provides for a cushion having an array of hollow suspension elements that create a displaceable constant restoring force, shape-matching surface. The suspension elements include a load-bearing surface, end walls, and an optional bottom wall or membrane that closes off the hollow suspension element. Each bottom wall, when present, has an optional vent of a predetermined size formed therein to allow venting of air from the hollow suspension element when force is exerted on the support surface. The base of each suspension element generally has rectangular configuration permitting a high density of suspension elements per area or cushion for more contact area to the supported person. The array of suspension elements is arranged in a pattern across the expanse of the cushion wherein the longitudinal axis of each suspension element is positioned at a right angle relationship to the longitudinal axis of the adjacent suspension elements. This results in greater longitudinal stability and effective surface area at the anatomical contact site.

The array of suspension elements creates a cushion that when engaged matches the shape of an object placed thereon with nearly uniform, predetermined counter forces. The size of the vent in the suspension element base wall, or located in a film used to seal the bottom of the suspension element controls the rate of air flow out of the suspension element and hence allows for damping control of the counter force exerted by the suspension element. The employment of equal counter forces while matching the shape of a person is beneficial in facilitating blood flow in those tissues that are under load. The primary benefit is in minimizing deformation of the vascular network, which provides blood flow to those local tissue cells.

It will be appreciated by those skilled in the art that the suspension elements of the present invention provide a plurality of ways by which the collapse or deformation of the elements and the constant restoring force may be controlled or adjusted. For example, arrangement or position wall thickness, material selection, cross-sectional configuration, the presence or absence of a bottom wall, the size of the opening in the bottom wall, if present, provide for optimal control of the deflection characteristics and constant restoring forces of the array of suspension elements comprising a cushion It will be appreciated that while reference is made primarily to cushions, the same inventive principles are applied to mattresses and or any other support surface for the proper support and positioning of a user. Hence the term cushion as used in herein and in the appended claims is intended to encompass conventional cushions, wheelchair cushions, mattresses, mattress overlays, heel pads, insoles, chair backs and any other anatomical support structure.

Figure 2:
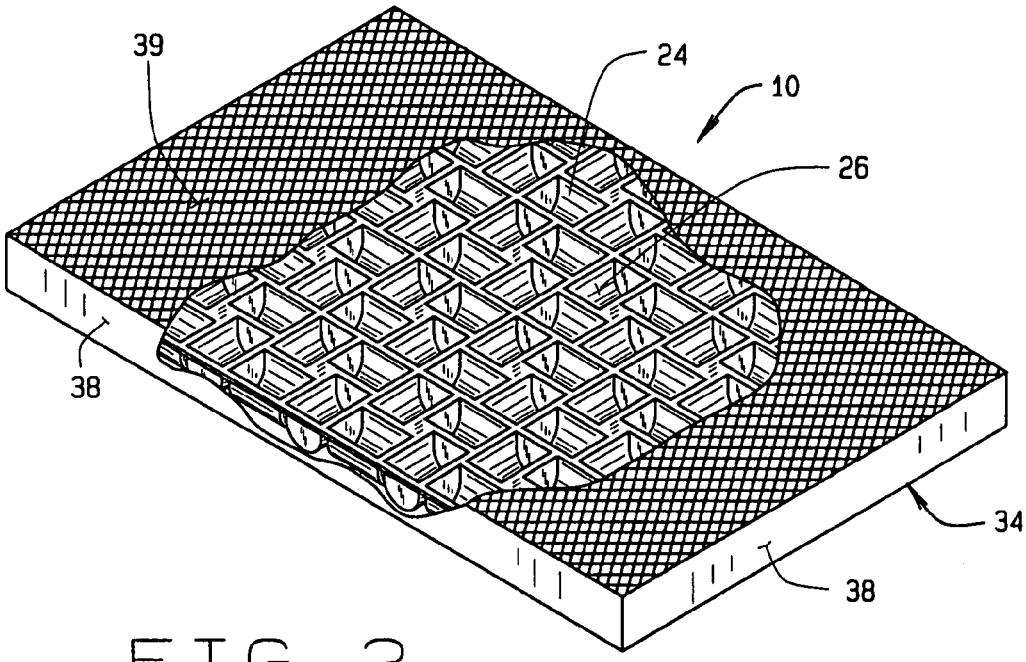
FIG. 2 is a bottom perspective view of the cushion of FIG. 1 without a base and with the openings into the suspension elements exposed.
Figure 3:
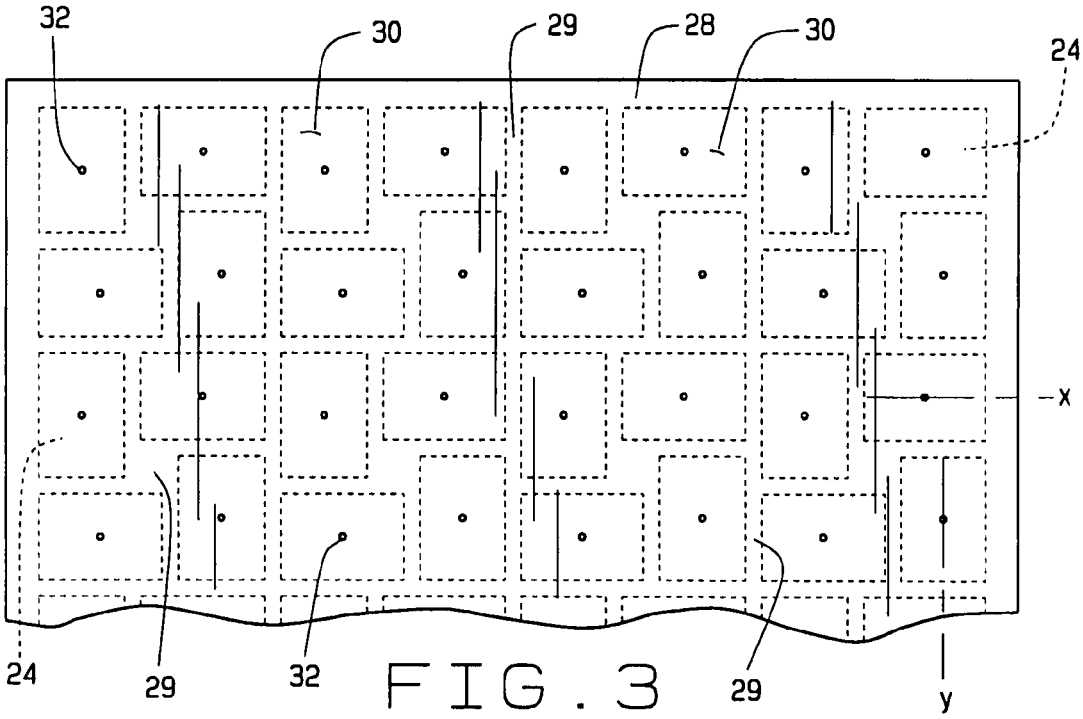
FIG. 3 is a partial bottom plan view of a cushion of the present invention with the base intact.
Figure 4:
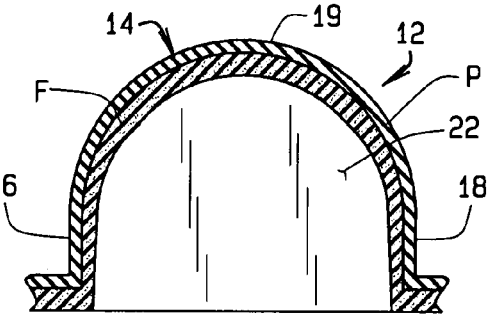
FIG. 4 is a cross-sectional view of a suspension element of the present invention.
Figure 5:
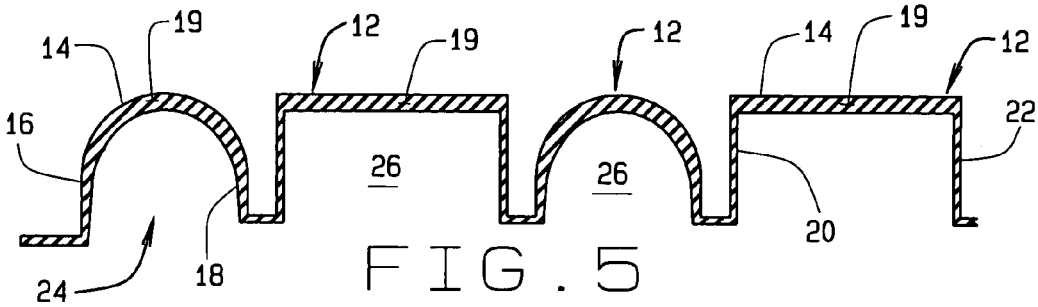
FIG. 5 is a representational cross-sectional view of a partial row of suspension elements from a cushion of FIG. 1.

FIGS. 1 through 5 illustrate one representative embodiment of a cushion of the present invention, indicated generally by reference numeral 10. Cushion 10 includes an array of individual suspension elements 12. As seen in FIGS. 4 and 5, the suspension elements 12 have a load-bearing surface 14. The load-bearing 14 surface, in its normal state, has opposed vertical sides 16 and 18 and a top surface 19. The material thickness of the load bearing surface is greatest at the top surface and the thickness decreases or tapers toward the base. That is, the wall thickness of the arch shape becomes less thick. This taper generally occurs when the outside curve of the arch is greater or a different curve, i.e., elliptical, curve from the inside arch. Having a taper will influence the buckling function, which helps to create a constant restoring force, during the range of deflection, as will be described below. The material thickness of the load bearing surface, the taper or both may be adjusted to so as to obtain an optimal buckling or deformation characteristics for any given application.

The suspension element 12 also a first end wall 20 and second end wall 22. The suspension elements are hollow and the load-bearing surface and end walls define an opening 24 and an inner chamber 26. Also, it will be appreciated that the configuration of each opening 24 of each suspension element is rectangular, which allows for the adjacent placement of multiple suspension elements, side-by-side in rows across the expanse of cushion 10.

As seen in FIG. 4, the cushion can comprise a composite material wherein the suspension elements 12 are constructed from a molded foam F and the outer surface is a thin polyurethane layer P that creates a smooth, moisture impervious surface. Alternatively, the foam layer F may be covered by a layer P of neoprene or other rubber. Foam material works well and reduces the overall weight of the cushion. In other embodiments, the entire suspension element may be molded from neoprene, with a skin of neoprene to seal the outer surface. Again, the choice of material, i.e. foam, foam and polyurethane composite, neoprene or so forth can be used to obtain desirable deflection or deformation and constant force restoring characteristics.

FIG. 3 illustrates the bottom of one embodiment of a cushion 10 which includes a substantially flat base 28 which forms a base or bottom wall 30 for each of the individual support elements 12. It will be appreciated that base 28 can be a continuous web of flexible material, such as polyurethane film P or other membrane-type material, and is adhered to the bottoms of the suspension elements and around opening 24, as at sealed areas 29, so that chamber 26 is enclosed and each suspension element is isolated and discrete and the inner chambers 26 of the suspension elements are not in fluid communication with those of the adjoining suspension elements. The enclosed suspension element is more sanitary than an open structure and more durable. The cushion may be constructed from an array of support elements that have no base or bottom wall and are open on the bottom As seen in FIG. 3, there may be a hole or vent 32 formed in each bottom wall 30. Although shown positioned substantially in the center of bottom wall 30, the vent may be place anywhere in the bottom wall as long as the vent 32 is in fluid communication with chamber 26. It will be appreciated that the diameter of vent 32 is predetermined so that there is a predetermined rate of airflow out of the chamber of each suspension element, as will be described in more detail below. Positioning of the vent 32 in bottom wall 30 also may affect the rate of airflow out of the suspension elements. The vent 32 controls the rate of expelling the air trapped inside chamber 26 of suspension element 12 and imparts a higher viscosity feel to the cushion than could be provided by mechanical means alone. Of course, the suspension elements may have bottom wall 30 that has no hole or vent. Or, a cushion could employ some suspension elements with vents and some without, depending upon the desired effect. Moreover, employment of a bottom wall or no bottom wall is another factor that allows control of the collapsing characteristics of the individual support elements 12.

In any event, the size of vent 32, if one is present, is determined by the dimensions of the suspension element and the volume of chamber 26 so as to impart the desired viscous feel to the cushion as the user is positioned on the cushion. In one representative embodiment, the suspension elements are approximately $1\frac{1}{4}^{th}$ inches long, approximately 1½ inches wide and approximately 1½ inches in height. In this representative embodiment a vent hole of sufficient diameter is used to impart a desired feel through the controlled expulsion of air during seating. Of course, the suspension elements can be of any desired dimensions. The size of the vent 32 can vary to achieve desired support characteristics.

Figure 1:
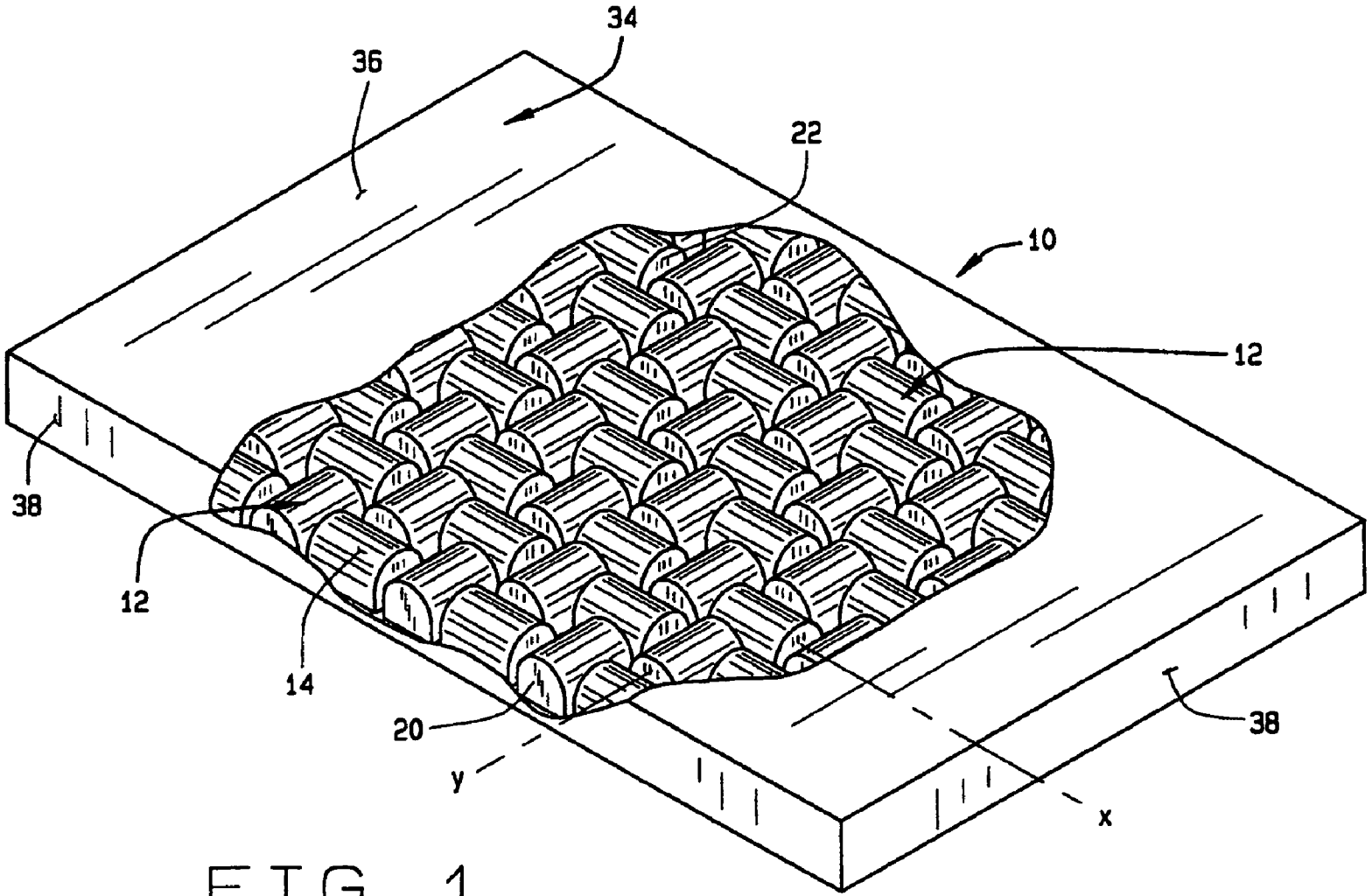
FIG. 1 is a perspective view of one embodiment of a cushion of the present invention with a cover partially cut away.

In one aspect of the invention the longitudinal axis x of one suspension element 12 is positioned at a right angle to the longitudinal axis y of the adjacent support element as seen in FIGS. 1 and 3. As best seen in FIG. 5, the end walls 20 and 22 of a suspension element are directed toward the sides 16 and 18 of the load-bearing surfaces 14 of the adjacent suspension elements 12.

Those suspension elements having longitudinal axis x are arranged in a plurality of rows with the axes of the suspension elements in any given row being in rectilinear alignment. Those suspension elements with longitudinal axis y are arranged in a plurality of rows with the axes of the suspension elements in any given row being in rectilinear alignment. Placing each suspension element at right angles to the adjacent suspension elements promotes lateral stability of the individual suspension elements and enhances motion stability for the user positioned on the cushion, as will be discussed below. The cushion can have any number of rows of suspension elements, depending upon the desired size of the cushion.

In the embodiment of FIGS. 1 through 5, the load-bearing surface 14 of each suspension element 12 has an arcuate top surface 19 creating a suspension element 12 having a substantially arch-shaped cross-sectional configuration. The cross-sectional configuration of the support elements affects the compression or deformation characteristics of the suspension element 12 when downward force is applied. For example, when a user is seated on cushion 10, the load or downward force on the support elements will cause the suspension elements to partially compress or deform. Also as seen in FIG. 5, the substantially uniform cross-sectional material thickness of load-bearing surface 14 is greater than the material thickness of the end walls 20 and 22. Control or modification of the relative material thicknesses of the load-bearing surface to the material thickness of the end walls can be used to achieve desirable deformation and restoring force characteristics.

Figure 7:
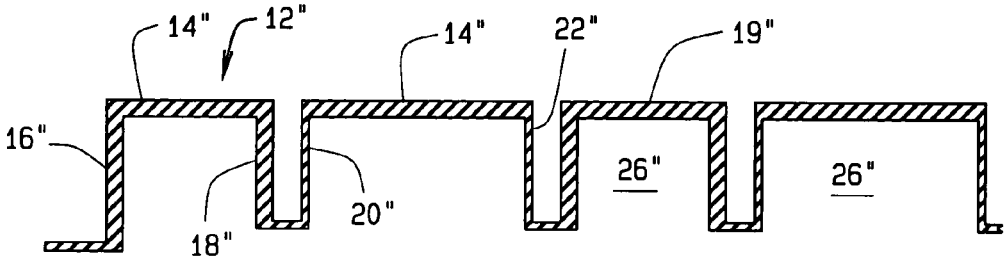
FIG. 7. is a representational cross-sectional view of a partial row of suspension elements having another alternative configuration.
Figure 8:
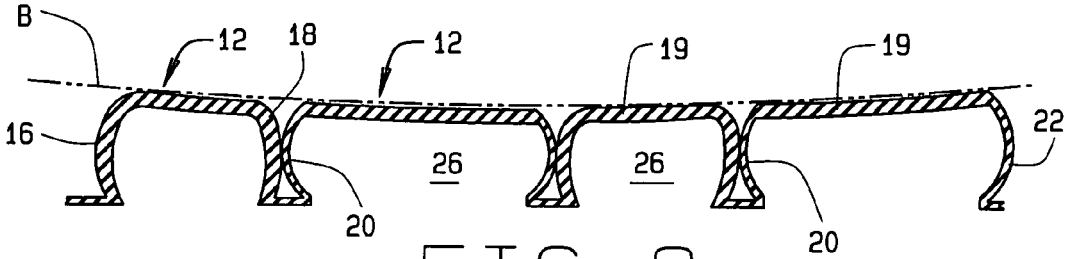
FIG. 8 is a representational cross-sectional view of a partial row of suspension elements of FIG. 4 under load.

As shown in FIG. 7, the load bearing surface 14 is displaceable and vertical sides 16 and 18 may deform and bow outwardly as force is applied to the cushion, for example by a user's body B positioned on the cushion. The air entrapped in chamber 26 is released slowly through vents 32 and, therefore, the remaining air is compressed and causes end walls 20 and 22 to deform and actually to distend outwardly toward to the adjacent support elements 12. This deformation or bowing of the support surface and distension of end walls 20 and 22 is referred to as the deflection travel of the suspension element 12.

Under load, the end walls 20 and 22 abut sides 16 and 18 of the load bearing surface 14 of the adjacent suspension element so that the deformed or deflected suspension elements 12 form a substantially uniform support surface that conforms to the shape of the user's body B. The end walls 20 and 22 provide stability in the deflection travel of the suspension element 12 under load. That is, the cushion will feel more stable to a positioned user due to the reduced deflection travel. Moreover, the restorative force of the deformed suspension elements 12 is nearly constant throughout its deflection travel. the cushion* assumes the shape while exerting a uniform support force on the body B positioned on the cushion to minimize deforming soft tissues which facilitates blood flow.

As seen in FIGS. 1 and 2, the entire cushion can be enclosed in a cover 34. The cover cooperates with the support elements 12 to provide a generally uniform support surface. The cover can have a top panel 36 and side panels 38 made from a stretchy material, such as a stretchy nylon or spandex and a bottom panel 39 made of a tacky or rubberized material or other material having a higher coefficient of friction than the support surface on which the cushion is placed to keep the from sliding. One such cushion cover is disclosed in the inventor's U.S. Pat. No. 5,111,544, which is incorporated herein by reference. Of course, any type of cover that functions appropriately is intended to be within the scope of the invention.

The suspension elements 12 generally are molded in sheets from high density foam using a two-piece mold having a female and matching or different male shape with clearance for developing a suitable wall thickness and shape. Molding the product permits using multiple layers of different materials by using the female side of the mold to first vacuum form a plastic film or form a rubber film by dipping to serve as the top and side that the user would engage. The mold then is filled with foam material. The male side of the mold is inserted. The foam is allowed to cure. The foam can be injection molded if a closed mold is used. The cushion can comprise a combination of a polyurethane outer film with an inner shell of polyethylene or polyurethane foam to produce a more durable structure with improved moisture and abrasion resistance and flex life. The polyurethane film or membrane can form the base 28 of the cushion and, of course, the bottom walls 30 of the suspension elements.

Figure 6:
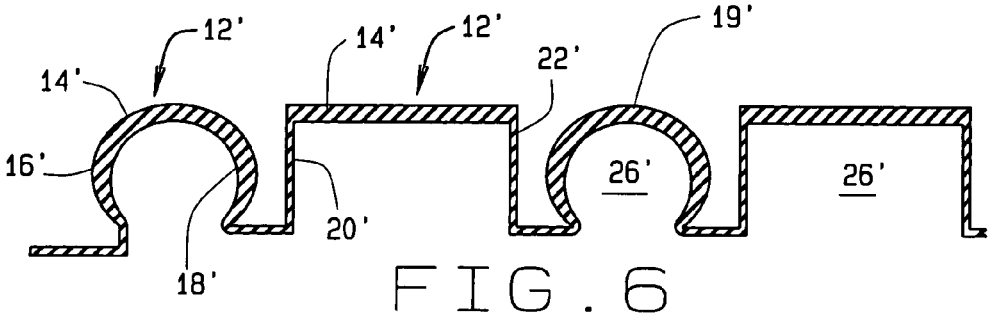
FIG. 6. is a representational cross-sectional view of a partial row of suspension elements having an alternative configuration.

FIGS. 5 and 6 illustrate alternative aspects of suspension elements of the present invention. As seen in FIG. 5, suspension elements 12' include a load bearing surface 14', side walls 16' and 18', end walls 20' and 22', and a bottom wall (not shown) which define inner chamber 26'. Load bearing surface 14' includes a rounded top surface 19'. It will be appreciated that a cushion constructed of suspension elements 12' may include a bottom wall with a vent, as already explained. Load bearing surface 14' has a substantially ovoid or elliptical cross-sectional configuration with side walls 16' and 18' having substantial curvature. It will be noted that the material thickness of load bearing surface 14' is greater than the material thickness of end walls 20' and 22'. The suspension elements 12' are positioned at right angles to each other as previously discussed.

FIG. 6 illustrates suspension elements 12" having load bearing surface 14" with a substantially vertical side walls 16" and 18" and horizontal, substantially flat top wall 19". Consequently, suspension elements 14" have a substantially rectangular cross sectional configuration. As with the other illustrated designs, suspension elements 12" include end walls 20" and 22" that have a material thickness less than the material thickness of load bearing surface 14". When employed in a cushion, suspension elements 12" could include a vented bottom wall and an inner chamber 26". FIGS. 5 and 6 illustrate that representational embodiments of cushion suspension elements of the present invention can have any acceptable cross-sectional configuration that allow the suspension elements to function in accordance with the broader principles of the invention. Consequently, although three representational embodiments are shown, the scope of the invention and the appended claims should not be limited to any preferred or illustrative embodiments.

Figure 9:
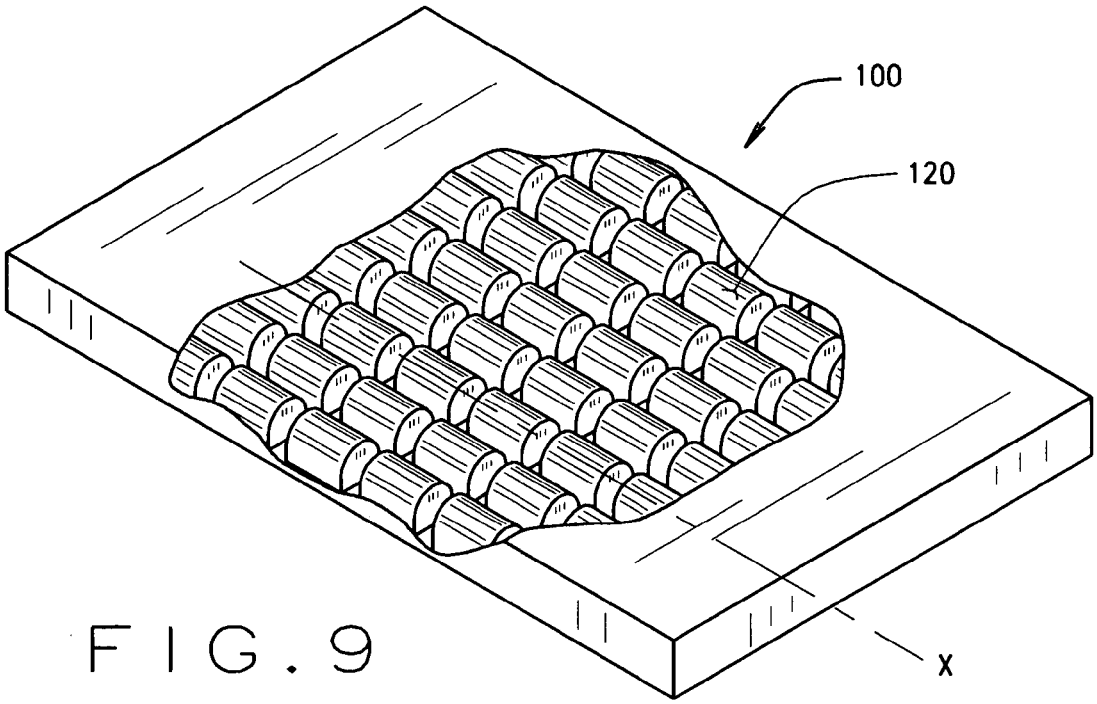
FIG. 9 is a perspective view of another embodiment of a cushion of the present invention with a cover partially cut away.
Figure 10:
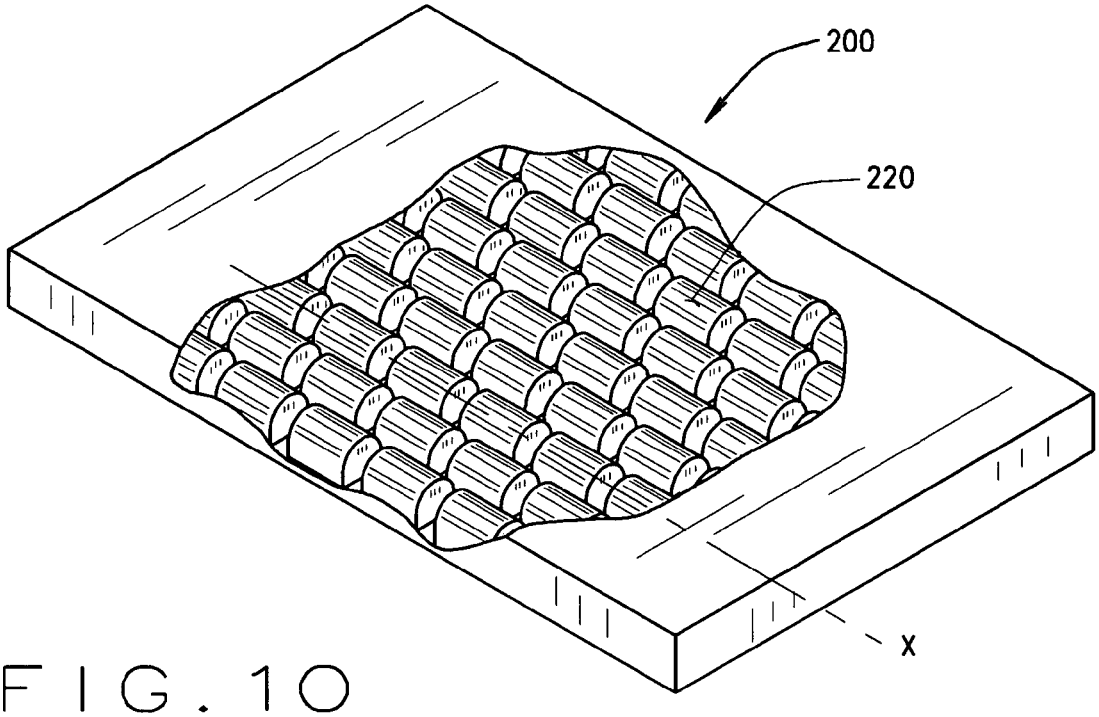
FIG. 10 is a perspective view of another embodiment of a cushion of the present invention with a cover partially cut away.

FIGS. 9 and 10 illustrate other representative embodiments of the present invention. FIG. 9 shows an embodiment of a cushion 100 having an array of suspension elements 120 arranged in rows with the longitudinal axes of the suspension elements in each row being in rectilinear alignment . . . . FIG. 10 depicts an embodiment of a cushion 200 having an array of suspension elements 220 arranged in rows with the longitudinal axes of the suspension elements in each row being in rectilinear alignment. The suspension elements 120 and 220 are constructed similar to those described above. However, they are not positioned at right angles.

Cushion 100 provides for axially aligned suspension elements 120 that are positioned side-to-side with the suspension elements in adjacent rows of suspension elements. Cushion 200 provides for axially aligned suspension elements 220 that are off-set or staggered relative to the suspension elements in adjacent rows of suspension elements. It will be appreciate by those skilled in the art that the relative positioning of adjacent support elements can influence the deformation and constant restoring force characteristics of the cushions. In the embodiments of FIGS. 9 and 10, those characteristics also can be modified by manipulation of the choice of materials, the material thickness or taper of the load bearing wall, the relative material thickness of the end walls, the use of a bottom wall and the size of the vent in the bottom wall, if present.

Moreover, the foregoing written description and accompanying drawings are intended to be illustrative of the broader aspects of the invention and the best mode of working the invention presently known to the inventor and should not be construed as limiting the scope of the invention as defined by the appended claims.

The invention claimed is:

1. A cushion comprising:

an array of individual molded foam suspension elements arranged in a pattern wherein a longitudinal axis of each suspension element in the array is positioned at a right angle to the longitudinal axes of the adjacent suspension elements;

each said suspension element having a displaceable load-bearing surface having a substantially arch-shaped cross-sectional configuration, a first end wall, a second end wall, and a bottom wall, said load-bearing surface and said recited walls defining an inner chamber, wherein the material thickness of the load-bearing surface is greater than the material thickness of the recited end walls whereby said ends walls distend outwardly when force is applied to said load-bearing surface; and each said bottom wall having an opening formed therein of a predetermined size to allow a controlled release of air from the inner chamber when force is applied to said load bearing surface.

2. The cushion of claim 1 further comprising a cover around the array of individual molded foam suspension elements.

3. The cushion of claim 1 wherein the array of individual molded foam suspension elements is molded from polyurethane foam having a polyurethane film outer layer.

* * * * *